United States Patent [19]

Suits

[11] Patent Number: 4,469,779

[45] Date of Patent: Sep. 4, 1984

[54] INFRARED COLOR PHOTOGRAPHIC FILM

[75] Inventor: Gwynn H. Suits, Ann Arbor, Mich.

[73] Assignee: Environmental Research Institute of Michigan, Ann Arbor, Mich.

[21] Appl. No.: 475,773

[22] Filed: Mar. 16, 1983

[51] Int. Cl.[3] ..... G03C 7/00; G03C 1/46

[52] U.S. Cl. ..... 430/363; 430/503; 430/507

[58] Field of Search ..... 430/503, 507, 584, 363; 354/68, 100; 358/109; 350/1.1; 250/330, 482.1

[56] References Cited

U.S. PATENT DOCUMENTS

| | | | |
|---|---|---|---|
| 2,391,198 | 12/1945 | Seymour | 430/503 |
| 2,927,024 | 3/1960 | Woodward et al. | 430/507 |
| 3,715,962 | 2/1973 | Yost | 354/78 |
| 4,112,459 | 9/1978 | Gautier et al. | 358/332 |
| 4,227,211 | 10/1980 | Disbrow | 358/109 |
| 4,310,847 | 1/1982 | Frohbach et al. | 358/54 |

*Primary Examiner*—J. Travis Brown

*Attorney, Agent, or Firm*—Krass & Young

[57] ABSTRACT

Infrared color film is constructed with a particular arrangement of dye sensitized layers so that the film may respond to the entire visible spectrum, including the blue visible band, as well as the infrared band by choosing the appropriate camera lens filter.

7 Claims, 3 Drawing Figures

INFRARED COLOR PHOTOGRAPHIC FILM

TECHNICAL FIELD

This invention relates to photographic film and, more particularly, to infrared color photographic film.

BACKGROUND ART

FIG. 1 schematically illustrates a cross-sectional view of conventional infrared color photographic film, such as Kodak Infrared Etachrome film. Upon a base A is superimposed three dye sensitized layers B, C and D. Each of the layers generally consists of an emulsion comprised of silver halide particles and a sensitizing dye. The sensitizing dye is a compound added to the emulsion layer to provide sensitivity to another portion of the spectrum in addition to the emulsion's natural sensitivity to blue light provided by the silver halide particles. In the prior art example of FIG. 1 layer B contains a dye sensitive to the infrared band, more particularly, the near infrared band with wavelengths of 700–1,000 nanometers. Layer C includes a dye sensitive to light in the visible red band whereas layer D contains a dye sensitive to the visible green band.

Infrared color film of this type is generally referred to as a false-color, reversal film and finds particular utility in aerial photography. It differs from ordinary color film in that the three sensitized layers are sensitive to green, red and infrared radiation instead of having the usual blue, green and red sensitivities. A yellow filter, such as the Kodak Wratten filter No. 12, is used on the camera lens to absorb the blue radiation to which all three layers are sensitive. When the film is processed, the green-sensitive layer D is developed to a yellow positive image; the red-sensitive layer C to a magenta positive image; and the infrared sensitive layer B to a cyan positive image. Since conventional film uses subtractive techniques, the green areas of the actual object actually are viewed as blue, the red comes out green, and the infrared regions are red when observing an image formed by the processed film. These techniques are well known in the art and the reader is referred to the technical literature for more details, see, e.g. *Manual of Aerial Photography,* Am. Soc. of Photogrammetry, 1st Ed. (1968).

One of the problems with conventional infrared color photographic film is that it is not as versatile as it could be. With the normally used Wratten 12 filter, conventional IR film is limited to providing information relating to the green, red and infrared bands. By filtering, some choice of just two of these bands may be provided. In any event, known IR films do not offer the option of responding to the blue light in only one of the sensitized layers. In other words, all of the layers in the prior art film are sensitive to blue light and thus, the developed film is not capable of providing information in the blue visible band. In some instances it would be highly advantageous to obtain information contained in the blue visible band. For example, the contrast between the blue visible band and the IR band is advantageous in detecting mine fields in aerial reconnaissance. Another instance is in taking pictures of objects at the bottom of bodies of water where the blue and green bands are useful for water penetration. Those skilled in the art will find other applications in which a more versatile infrared film may be used.

SUMMARY OF THE INVENTION

The infrared color film of the present invention incorporates an internally formed filter layer in combination with three dye sensitized layers arranged in a special order to provide a more versatile film. The first and second layers adjacent the base are sensitized to the red and infrared bands. The third layer is a minus blue filter, i.e. including means for filtering out visible blue band light. The top layer is dye sensitized to the visible green band. As will appear from the following specification, this film construction enables the user to obtain photographic images containing information from various bands depending upon the selection of camera filters.

BRIEF DESCRIPTION OF THE DRAWINGS

The various advantages of the present invention will become apparent to one skilled in the art upon reading the following specification and by reference to the drawings in which.

DESCRIPTION OF THE PREFERRED EMBODIMENT

Figure 2:
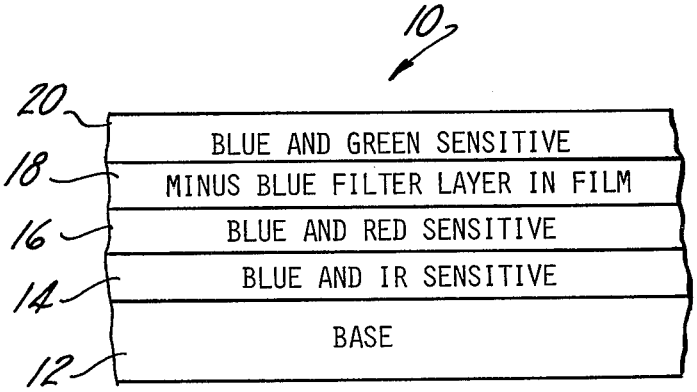
FIG. 2 is a partial side cross-sectional view schematically illustrating the infrared color photographic film of the present invention.

Turning to FIG. 2, the infrared color film 10 of this invention employs a transparent plastic base 12 conventionally used in the photographic industry. A layer 14 on base 12 is dye sensitized to the near infrared band. On top of layer 14 lies layer 16 which is dye sensitized to the red visible band. The vertical order of layers 14 and 16 is not important, i.e. layer 14 may be red sensitized and layer 16 IR sensitized. Layer 18 serves as a blue filter in that it is operative to filter out visible blue band light. Top layer 20 is dye sensitized to the green visible band.

Figure 1:
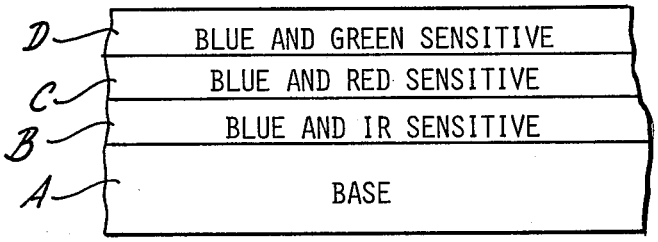
Fig-1 Prior Art
FIG. 1 is a partial cross-sectional side view schematically illustrating infrared color photographic film of the PRIOR ART.

It is important that the green sensitized layer 20 form the outer most stratum of the film and that blue filter layer 18 is disposed between layer 20 and the layers 14, 16 whose order is not critical. The special order of the layers of the film 10 of the present invention is contrasted to that of the prior art film shown in FIG. 1 where the order of the layers is not material to its operation. All of the layers are sensitive to the blue part of this spectrum because the silver halide, which is the material that forms the latent image upon exposure, will, itself, absorb blue light and create the latent image independently of the dye sensitization within the layer. The light sensitive layers 14, 16 and 20 of film 10 likewise are formed of an emulsion containing silver halide particles and, in fact, are preferably identical to their counterparts in the prior art film. For example, they may contain the same sensitizing dye, color formers and other special function additives such as coating aids, stablizing agents, etc. that the film manufacturer normally uses for its conventional IR film. One of the primary advantages of the present invention is that more versatile results can be obtained without requiring the manufacturer to significantly change its film making or developing procedures.

The filter layer 18 of the film of the present invention can be formed of the same non-light-sensitive material as the yellow filter layer found in normal color film which operates in the blue, green and red bands. Filter layer 18 operates to prevent blue light from exposing lower layers 16 and 14. After the latent image has been formed, filter layer 18 is made transparent either by chemical reaction with film processing chemicals or is dissolved away during processing, much in the same manner as the yellow filter layer in normal color film.

Figure 3:
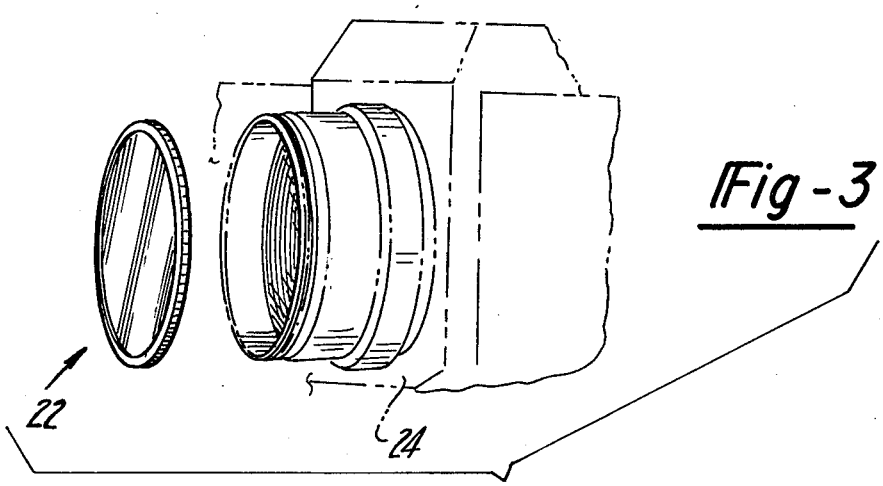
FIG. 3 is a perspective view of a typical camera and filter assembly in which the film of the present invention may be used.

The film 10 of the present invention enables the user to chose one of three possible sets of three spectral bands of film operation by the appropriate choice of the camera lens filter 22 used with camera 24 shown in FIG. 3. By using a minus blue lens filter such as a Wratten No. 12 filter on the camera, film 10 will respond to light in the green, red and infrared bands. The minus blue filter filters out the blue light leaving only the green, red and infrared bands to expose layers 20, 16 and 14, respectively. In this mode of operation, the integrally formed minus blue filter layer 18 in the film is somewhat redundant. However, this redundancy is more than made up for by the increased versatility afforded the user in the other operational modes which will now be described.

Instead of using a minus blue lens filter, the user may opt for a minus green lens filter such as a Wratten No. 32. In this case, the blue light will not activate the red sensitized layer 16 or infrared sensitized layer 14 as would be the case in the prior art film construction. This is due to the fact that layer 18 serves to filter out the blue light and prevents it from passing to layers 16 and 14. Thus, in this operational mode, the same film 10 will develop an image containing information relating to the blue, red and infrared bands.

Still another option is provided by using either no filter at all or some light-yellow color balancing camera lens filter. In such case, film 10 will respond to the combined blue and green bands in layer 20, together with the red and infrared bands in layers 16 and 14, respectively.

Thus, those skilled in the art can appreciate that the IR film of the present invention exhibits markedly more versatility than conventional IR film without duly increasing costs to the manufacturer or inconvenience to the user. From a manufacturer's standpoint the technology for manufacturing the film of the present invention already exists. A switch can be made to the new film as a replacement for the old. Those customers used to the old film can use it in exactly the same way with exactly the same filters and achieve exactly the same results. However, the customer always has the additional option of alternative bands of operation if he desires merely by using different lens filters.

Another important advantage of this versatile color film is in the detection of camouflage paints. Typically, the manufacturer of military equipment uses camouflage paints for the purpose of making his equipment resemble the colors of natural backgrounds such as soils and green vegetation. It is relatively easy to design the paints such that the equipment is not easily detected with aerial photography using conventional IR film responding to the standard green, red and IR bands. If, however, other bands may be detected merely by changing camera filters in the manner provided by this invention, the task of the camouflage paint manufacturer is greatly increased since he will not know which option will be selected for aerial photography.

Those skilled in the art will come to appreciate the full scope of the advantages of the present invention upon a study of the specification, drawings and claims.

I claim:

1. Infrared color photographic film comprising:

a transparent base;

first and second layers adjacent the base, one of which is dye sensitized to the infrared band, the other of which is dye sensitized to the visible red band;

a third layer including means for filtering out light in the visible blue band from impinging the first and second layers during exposure of the film; and an outer layer dye sensitized to the visible green band.

2. The film of claim 1 used in combination with a minus green camera lens filter whereby the film responds to light in the blue, red and infrared bands.

3. The film of claim 1 used in combination with a camera having no filter whereby the film responds to light in the combined blue-green, red and infrared bands.

4. The film of claim 1 used in combination with a minus blue camera lens filter whereby the film responds to light in the green, red and infrared bands.

5. A method of generating color infrared pictures, said method comprising:

inserting film in a camera, said film having a transparent base; first and second layers adjacent the base, one of which is dye sensitized to the infrared band and the other of which is dye sensitized to the visible red band; a third layer including means for filtering out light in the visible blue band from impinging the first and second layers during exposure; and an outer layer dye sensitized to the visible green band;

mounting a minus-green lens filter on the camera;

exposing the film;

developing the film in such manner that the means for filtering light in the visible blue band becomes transparent; and whereby the developed picture contains image information relating to the blue, red and infrared bands.

6. A method of generating color infrared pictures, said method comprising:

inserting film into a camera, said film having a transparent base; first and second layers adjacent the base, one of which is dye sensitized to the infrared band, the other of which is dye sensitized to the visible red band; a third layer including means for filtering out light in the visible blue band from impinging the first and second layers during exposure; and an outer layer dye sensitized to the visible green band;

exposing the film;

developing the film in such manner that the means for filtering out light in the visible blue band becomes transparent; and whereby the developed picture contains image information relating to the combined blue-green, red and infrared bands.

7. A method of generating color infrared pictures, said method comprising:

inserting film into a camera, said film having a transparent base; first and second layers adjacent the base, one of which is dye sensitized to the infrared band, the other of which is dye sensitized to the visible red band; a third layer including means for filtering out light in the visible blue band from impinging the first and second layers during exposure; and an outer layer dye sensitized to the visible green band;

mounting a minus-blue lens filter on the camera;

exposing the film;

developing the film in such manner that the means for filtering out light in the visible blue band becomes transparent; and whereby the developed picture contains image information relating to the green, red and infrared bands.

* * * * *